United States Patent [19]

Ogawa et al.

[11] Patent Number: 4,941,761

[45] Date of Patent: Jul. 17, 1990

[54] PRINTING DEVICE CAPABLE OF LOW-DENSITY PRINTING AND HIGH-DENSITY PRINTING

[75] Inventors: Hiroo Ogawa, Nagoya; Takamitsu Kawai, Obu, both of Japan

[73] Assignee: Brother Kogyo Kabushiki Kaisha, Japan

[21] Appl. No.: 359,710

[22] Filed: May 31, 1989

[30] Foreign Application Priority Data

Jun. 13, 1988 [JP] Japan ..... 63-145020

[51] Int. Cl.[5] ..... B41J 3/12

[52] U.S. Cl. ..... 400/124; 400/121; 101/93.05

[58] Field of Search ..... 400/121, 124; 101/93.05

[56] References Cited

U.S. PATENT DOCUMENTS

| | | | |
|---|---|---|---|
| 4,010,835 | 3/1977 | Marton | 400/124 |
| 4,159,882 | 7/1979 | Sanders, Jr. et al. | 400/124 |
| 4,273,040 | 6/1981 | Sebrosky | 400/121 |
| 4,279,521 | 7/1981 | Kightlinger | 400/124 |
| 4,408,907 | 10/1983 | Bernardis | 400/124 |

FOREIGN PATENT DOCUMENTS

| | | | |
|---|---|---|---|
| 31421 | 7/1981 | European Pat. Off. | 400/124 |
| 3208104 | 8/1983 | Fed. Rep. of Germany | 400/124 |
| 54-12525 | 1/1979 | Japan | 400/124 |
| 56-6032 | 2/1981 | Japan | 400/124 |
| 56-67276 | 6/1981 | Japan | 400/124 |
| 208264 | 12/1982 | Japan | 400/124 |
| 89172 | 5/1984 | Japan | 400/124 |
| 60-40269 | 3/1985 | Japan | 400/124 |
| 160254 | 7/1986 | Japan | 400/124 VI |
| 627 | 9/1979 | PCT Int'l Appl. | 400/124 |

*Primary Examiner*—David A. Wiecking
*Assistant Examiner*—Steven S. Kelley
*Attorney, Agent, or Firm*—Oliff & Berridge

[57] ABSTRACT

A printing device including a printing head having a plurality of printing elements arranged in first and second rows and in a staggered manner; first printing control means for allocating print data to some of the printing elements in the first row spaced at regular intervals, in each of the intervals one or more of the printing elements being located, and for allocating the print data also to some of the printing elements in the second row spaced at regular intervals, in each of the intervals one or more of the printing elements being located, wherein any one of the printing elements allocated in the second row is located at a position intermediate of the adjacent ones of the printing elements allocated in the first row, whereby low-density printing is effected by the printing elements allocated by the first printing control means; second printing control means for allocating the print data to all of the printing elements in the first and second rows, whereby high-density printing is effected by the printing elements allocated by the second printing control means; and selecting means for selecting either of the first printing control means or the second printing control means.

7 Claims, 4 Drawing Sheets

PRINTING DEVICE CAPABLE OF LOW-DENSITY PRINTING AND HIGH-DENSITY PRINTING

BACKGROUND OF THE INVENTION

The present invention relates to a printing device capable of low-density printing and high-density printing.

In a conventional printing device such as an impact dot printer having a 9-pin wire dot head for example, high-density printing in one line is effected by scanning the wire dot head three times and feeding a print paper by ⅓ of a pitch of pins in each scan or pass of the wire dot head.

Another conventional printing device capable of high-density printing by a single pass of the wire dot head in printing one line of data is disclosed in U.S. Pat. No. 4,279,521. This prior art is shown in FIGS. 5 and 6. Referring to FIGS. 5 and 6, reference numeral 20 designates a 27-pin printing head including printing wires 21-1, 21-2 and 21-3 having printing styli 22-1, 22-2 and 22-3 arranged in three rows. That is, nine printing styli 22-1 in the first row are arranged at a pitch of 1/72 inches. Similarly, nine printing styli 22-2 in the second row and nine printing styli 22-3 in the third row are arranged at a pitch of 1/72 inches. A pitch between the printing styli 22-1 in the first row and the printing styli 22-2 in the second row is set to 1/216 inches. Similarly, a pitch between the printing styli 22-2 in the second row and the printing styli 22-3 in the third row is set to 1/216 inches.

The printing head 20 includes two stages of solenoid sections 26A and 26B for driving the printing styli 22-1, 22-2 and 22-3. The solenoid section 26A of the first stage includes a plurality of yoke cores 24A, a plurality of coils 25A wound around the yoke cores 24A, and a plurality of armatures 23A adapted to be electromagnetically attracted to the coils 25A. Some of the printing wires 21-1, 21-2 and 21-3 are connected to the armatures 23A. Similarly, the solenoid section 26B of the second stage includes a plurality of yoke cores 24B, a plurality of coils 25B wound around the yoke cores 24B, and a plurality of armatures 23B adapted to be electromagnetically attracted to the coils 25B. The other of the printing wires 21-1, 21-2 and 21-3 are connected to the armatures 23B.

However, such a construction of the printing head needs an increased number of parts to cause complication of the structure and assembly of the printing head.

SUMMARY OF THE INVENTION

It is an object of the present invention to provide a printing device which can effect low-density printing and high-density printing.

It is another object of the present invention to provide a printing device which may simplify the structure of the printing head and thereby improve the assembly thereof.

It is a further object of the present invention to provide a printing device which may effect high-density printing with improved heat radiation in conducting the low-density printing.

According to the present invention, there is provided a printing device comprising a printing head having a plurality of printing elements arranged in first and second rows and in a staggered manner; first printing control means for allocating print data to some of said printing elements in said first row spaced at regular intervals, in each of said intervals one or more of said printing elements being located, and for allocating said print data also to some of said printing elements in said second row spaced at regular intervals, in each of said intervals one or more of said printing elements being located, wherein any one of said printing elements allocated in said second row is located at a position intermediate of the adjacent ones of said printing elements allocated in said first row, whereby low-density printing is effected by said printing elements allocated by said first printing control means; second printing control means for allocating said print data to all of said printing elements in said first and second rows, whereby high-density printing is effected by said printing elements allocated by said second printing control means; and selecting means for selecting either of said first printing control means or said second printing control means.

When the first printing control means is selected by the selecting means, some of the printing elements in the first row and some of the printing elements in the second row as located in a predetermined spaced relationship to each other are selected, and the print data are allocated to the selected printing elements, thereby effecting the low-density printing. On the other hand, when the second printing control means is selected by the selecting means, all of the printing elements in the first and second rows are selected, and the print data are allocated to all the printing elements, thereby effecting the high-density printing.

The invention will be more fully understood from the following detailed description and appended claims when taken with the drawings.

DETAILED DESCRIPTION OF THE PREFERRED EMBODIMENT

Figure 1:
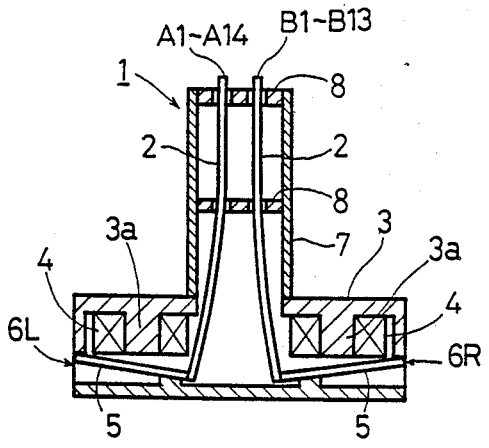
FIG. 1 is a sectional view of a 27-pin wire not head of a preferred embodiment according to the present invention.
Figure 2:
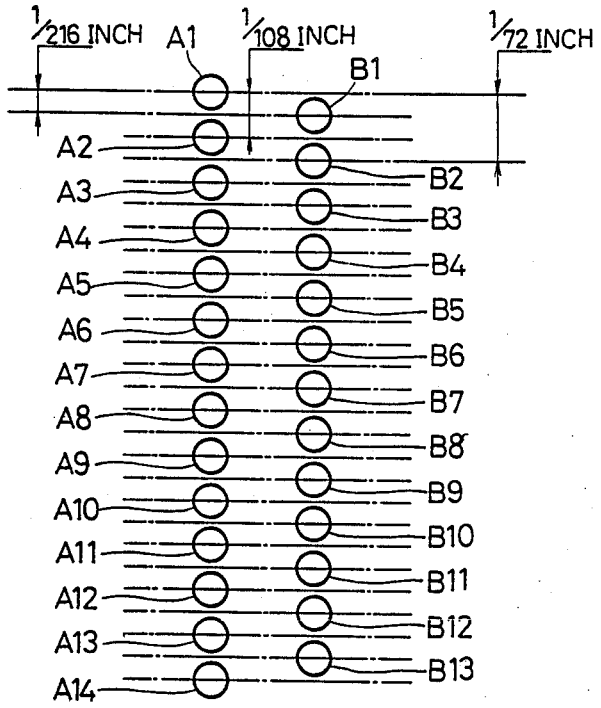
FIG. 2 is a plan view of the wire dot head shown in FIG. 1, illustrating the two-row staggered arrangement of the printing styli.

Referring to FIGS. 1 and 2, reference numeral 1 designates a 27-pin wire dot head for use with a printer. The wire dot head 1 includes twenty seven printing wires 2 each forming at its one end with a printing stylus. The twenty seven printing styli are arranged in two rows as shown in FIG. 2, the first row having fourteen printing styli A1–A14, while the second row having thirteen printing styli B1–B13. A pitch of the adjacent printing styli in the first row is set to 1/108 inches, and a pitch of the adjacent printing styli in the second row is also set to 1/108 inches. For example, the pitch between the printing styli A1 and A2 is set to 1/108 inches, and the pitch between the printing styli B1 and B2 is set to 1/108 inches. On the other hand, a pitch between one of the printing styli in the first row and one of the printing styli in the second row which is located nearest the printing stylus in the first row is set to 1/216 inches. For example, the pitch between the printing styli A1 and B1 is set to 1/215 inches. Thus, all the printing styli are arranged in a staggered manner.

As shown in FIG. 1, the wire dot head 1 includes a circular yoke 3 formed with twenty seven cores 3*a* around which twenty seven coils 4 are wound. There are provided twenty seven armatures 5 operatively opposed to the coils 4, one end of each armature 5 being connected to an outer circumference of the circular yoke 3, while the other end of each armature 5 being connected to a base end of each printing wire 2. Thus, the armature 5 is driven by energizing the corresponding coil 4 to project the printing stylus of the corresponding printing wire 2 as being guided by a pair of guide plates 8. The printing styli A1–A14 of the first row are driven by a left solenoid section 6L located in a left half portion of the circular yoke 3, while the printing styli B1–B13 of the second row are driven by a right solenoid section 6R located in a right half portion of the circular yoke 3. With this arrangement, the solenoid sections 6L and 6R are arranged in a single stage, thereby simplifying the structure and improving the installability.

Figure 3:
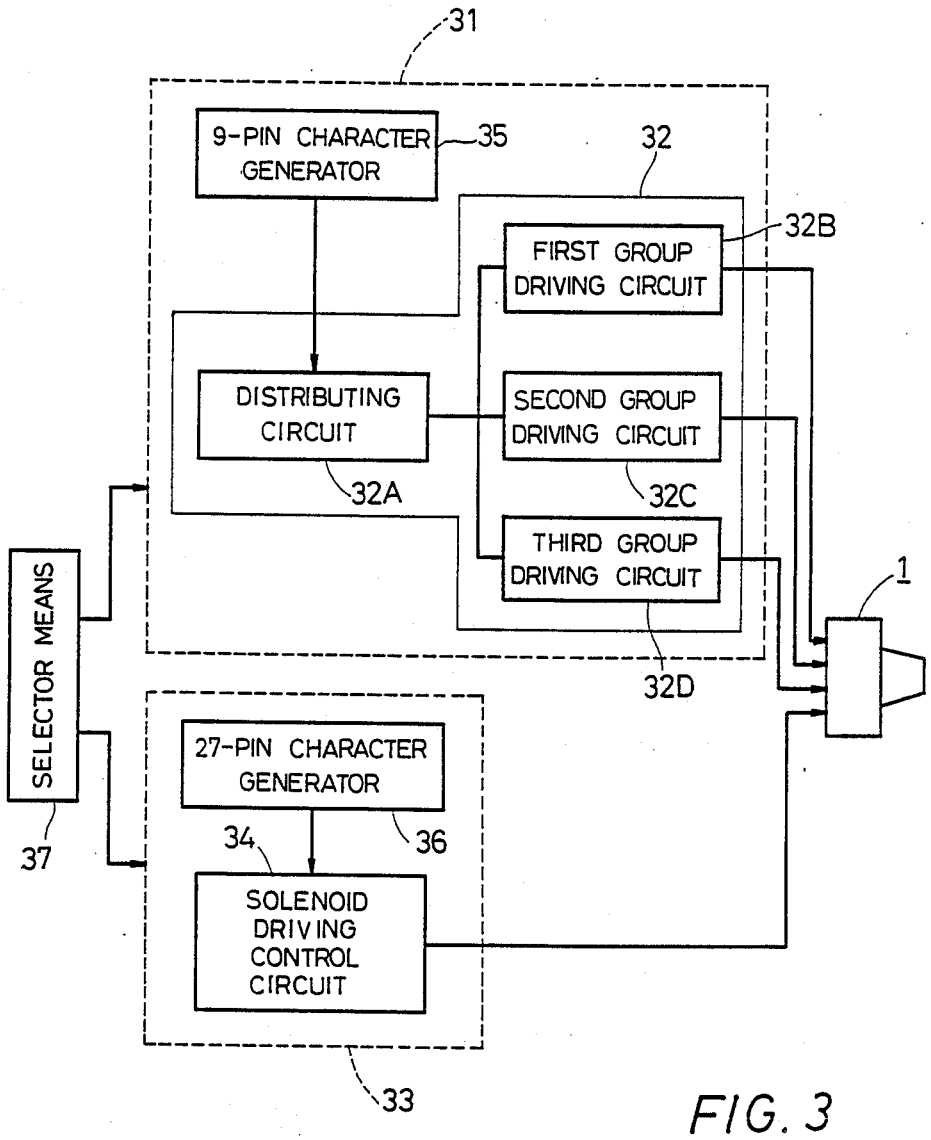
FIG. 3 is a block diagram for controlling the wire dot head shown in FIG. 1.

Referring to FIG. 3 which shows a block diagram of a control circuit for controlling the wire dot head 1, the wire dot head 1 is connected to solenoid driving control circuits 32 and 34 provided in first and second printing control means 31 and 33, respectively. The solenoid driving control circuits 32 and 34 supply a driving current to the coils 4 in the wire dot head 1 according to output data from a 9-pin character generator 35 and a 27-pin character generator 36, respectively, thereby projecting the printing styli of the printing wires 2 and effecting a printing operation against a printing medium such as a printing paper.

Either of the first printing control means 31 or the second printing control means 33 is alternatively selected by selector means 37 which is manually operated through a switch or is operated according to a signal from a host computer (not shown). When the first printing control means 31 is selected by the selector means 37 so as to effect low-density printing, the output data from the 9-pin character generator 35 are distributed by a distributing circuit 32A to one of three groups of the printing styli. The distributing circuit 32A generates a signal to first, second and third group driving circuits 32B, 32C and 32D in this order in a cyclic manner, thereby sequentially and cyclically driving the first, second and third group driving circuits 32B, 32C and 32D. Thus, the first group of the nine printing styli, the second group of the nine printing styli and the third group of the nine printing styli are sequentially and cyclically driven by the first, second and third group driving circuits 32B, 32C and 32D, respectively. Accordingly, the low-density printing is effected per line by each group of the nine printing styli.

On the other hand, when the second printing control means 33 is selected by the selector means 37 so as to effect high-density printing, all the twenty seven printing styli are driven by the solenoid driving control circuit 34 according to the output data from the 27-pin character generator 36. Thus, the high-density printing is effected per line by the twenty seven printing styli.

In effecting the low-density printing, the twenty seven printing styli are suitably grouped into the first to third groups. That is, the nine printing styli are selected in such a manner that a pitch between the adjacent printing styli is equalized. For example, referring to FIG. 2, the first group of the nine printing styli is decided by selecting A1, A4, A7, A10, A13 in the first row and B2, B5, B8, B11 in the second row. With this selection of the printing styli, the pitch between the adjacent printing styli A1 and B2 is equalized to the pitch between the adjacent printing styli B2 and A4. Such a spacial relationship is similarly effective for the other printing styli as selected. Similarly, the second group of the nine printing styli is decided by selecting A3, A6, A9, A12 in the first row and B1, B4, B7, B10, B13 in the second row, and the third group of the nine printing styli is decided by selecting A2, A5, A8, A11, A14 in the first row and B3, B6, B9, B12 in the second row.

Figure 4:
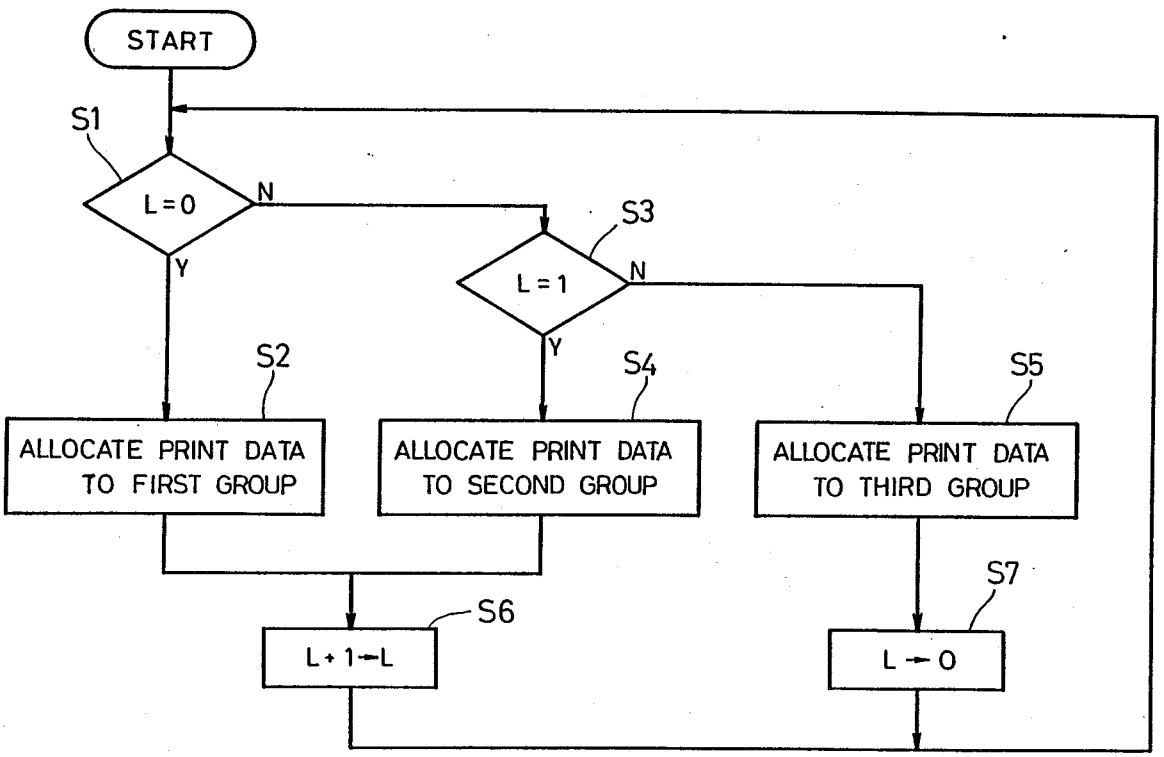
FIG. 4 is a flowchart for selecting first to third groups of the printing styli in effecting the low-density printing.
Figure 5:
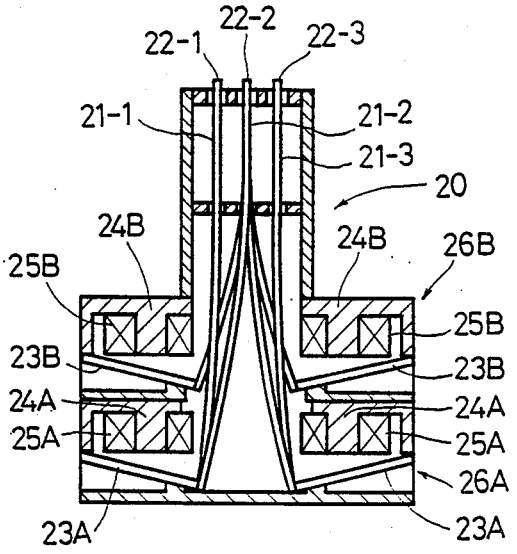
FIG. 5 PRIOR ART
FIG. 5 is a sectional view of the 27-pin wire dot head in the prior art.
Figure 6:
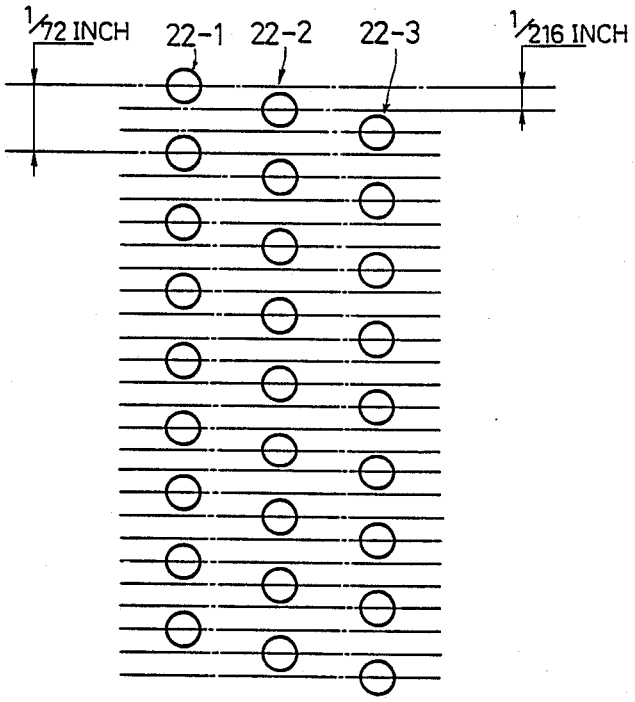
FIG. 6 PRIOR ART
FIG. 6 is a plan view of the wire dot head shown in FIG. 5, illustrating the three-row arrangement of the printing styli.

Referring to FIG. 4 which shows a flowchart for selecting the first to third groups of the printing styli, it is determined in step S1 whether or not a line counter value L is equal to 0, that is, whether or not a first line of data is to be printed. If the answer is YES in step S1, the program proceeds to step S2 wherein the first group of the printing styli (A1, A4, A7, A10, A13, B2, B5, B8 and B11 as shown in FIG. 2) is selected to effect printing of the first line. Then, the program proceeds to step S6 wherein 1 is added to the value L to newly set the value L to the sum. Then, the program is returned to step S1.

On the other hand, if the answer is NO in step S1, the program proceeds to step S3 wherein it is determined whether or not the line counter value L is equal to 1, that is, whether or not a second line of data is to be printed. If the answer is YES in step S3, the program proceeds to step S4 wherein the second group of the printing styli (A3, A6, A9, A12, B1, B4, B7, B10 and B13 as shown in FIG. 2) is selected to effect printing of the second line. Then, the program proceeds to step S6. If the answer is NO in step S3, the program proceeds to step S5 wherein the third group of the printing styli (A2, A5, A8, A11, A14, B3, B6, B9 and B12 as shown in FIG. 2) is selected to effect printing of a third line of data. Then, the program proceeds to step S7 wherein the line counter value L is set to 0. Then, the program is returned to step Sl. Thereafter, the same routine as mentioned above is repeated to effect printing of the subsequent lines of data by the first to third groups of the printing styli.

Thus, the first to third groups of the nine printing styli are succesively and cyclically used in printing the data. Accordingly, when the data are printed with a low printing density, all the twenty seven printing styli are uniformly used to thereby prevent deviation of wearing of the printing styli and extend the life of the wire dot head 1.

Having thus described the preferred embodiment of the invention, it should be understood that numerous structural modifications and adaptations may be made without departing from the spirit of the invention.

What is claimed is:

1. A printing device comprising:

a printing head having a plurality of printing elements arranged in first and second parallel but noncolinear rows and in a staggered manner which prints characters as the printhead scans a printline;

first printing control means for allocating print data to some of said printing elements in said first row spaced at regular intervals, one or more of said printing elements being located in each of said intervals, and for allocating said print data also to some of said printing elements in said second row spaced at regular intervals, one or more of said printing elements being located in each of said intervals, wherein any one of said printing elements allocated in said second row is located at a position intermediate of the adjacent ones of said printing elements allocated in said first row, whereby low-density printing is effected by said printing elements allocated by said first printing control means;

second printing control means for allocating said print data to all of said printing elements in said first and second rows, whereby high-density printing is effected by said printing elements allocated by said second printing control means with the rows in the same orientation relative to the printline as in the low-density mode; and selecting means for selecting either of said first printing control means or said second printing control means.

2. The printing device as defined in claim 1, wherein said one or more of said printing elements located in each of said regular intervals is an even number of said printing elements.

3. The printing device as defined in claim 1, wherein said first printing control means comprises a plurality of driving circuits for driving a plurality of groups of said printing elements allocated, and a distributing circuit for distributing said print data to one of said driving circuits.

4. The printing device as defined in claim 3, wherein said print data are distributed to one of said driving circuits successively and cyclically, whereby said plurality of said printing elements are uniformly driven.

5. A printing head for use with a printing device, comprising a first row of plural printing elements arranged at regular intervals and a second row of plural printing elements arranged at regular intervals in such a manner that each of said printing elements in said second row is located at a position intermediate of the adjacent ones of said printing elements in said first row, wherein said printing elements in each row are divided into three sub groups, each sub group in said first row including said printing elements so arranged as to skip every two of said printing elements in the remaining two sub groups in said first row, each sub group in said second row including said printing elements so arranged as to skip every two of said printing elements in the remaining two sub groups in said second row, and wherein each of said three sub groups in said second row is combined with each of said three sub groups in said first row to form a main group in such a manner that one of said printing elements in said second row is located at an intermediate position between the adjacent ones of said printing elements in said each sub group in said first row, whereby when one of said three main groups of said printing elements is selected, low-density printing is effected, while when all of said three main groups of said printing elements are selected, high-density printing is effected.

6. A printing device comprising:

a printing head having a plurality of printing wires arranged in first and second parallel but noncolinear rows and formed at their free ends with printing styli arranged in a staggered manner which prints characters as the printhead scans a printline;

a plurality of driving means provided in correspondence with said printing wires and annularly arranged in one stage for driving said printing wires;

first printing control means for allocating print data to some of said driving means for said printing wires in said first row spaced at regular intervals, one or more of said printing wires being located in each of said intervals, and for allocating said print data also to some of said driving means for said printing wires in said second row spaced at regular intervals, one or more of said printing wires being located in each of said intervals, wherein any one of said printing wires allocated in said second row is located at a position intermediate of the adjacent ones of said printing wires allocated in said first row, whereby low-density printing is effected by said printing wires allocated by said first printing control means;

second printing control means for allocating said print data to all of said printing wires in said first and second rows, whereby high-density printing is effected by said printing wires allocated by said second printing control means with the rows in the same orientation relative to the printline as in the low-density mode; and selecting means for selecting either of said first printing control means or said second printing control means.

7. The printing device as defined in claim 6, wherein each of said driving means comprises a core, a coil wound around said core, and an armature adapted to be driven by said coil for driving each of said printing wires.

* * * * *